US011104144B2

(12) United States Patent
Nishiwaki

(10) Patent No.: US 11,104,144 B2
(45) Date of Patent: Aug. 31, 2021

(54) LIQUID EJECTING HEAD AND LIQUID EJECTING APPARATUS

(71) Applicant: SEIKO EPSON CORPORATION, Tokyo (JP)

(72) Inventor: Tsutomu Nishiwaki, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/857,648

(22) Filed: Apr. 24, 2020

(65) Prior Publication Data

US 2020/0338896 A1 Oct. 29, 2020

(30) Foreign Application Priority Data

Apr. 26, 2019 (JP) ..... JP2019-085194

(51) Int. Cl.
*B41J 2/175* (2006.01)
*B41J 2/14* (2006.01)

(52) U.S. Cl.
CPC ..... *B41J 2/175* (2013.01); *B41J 2/14032* (2013.01); *B41J 2002/14475* (2013.01); *B41J 2202/12* (2013.01)

(58) Field of Classification Search
CPC .... B41J 2/175; B41J 2/14032; B41J 2202/12; B41J 2002/14475; B41J 2002/14306; B41J 2/15; B41J 2/14201; B41J 2/04581
USPC ..... 347/20, 40, 54, 68, 84, 85
See application file for complete search history.

(56) References Cited

U.S. PATENT DOCUMENTS

| | | | | |
|---|---|---|---|---|
| 10,549,539 | B2 * | 2/2020 | Katayama | B41J 2/14209 |
| 10,583,657 | B2 * | 3/2020 | Sugiura | B41J 2/1433 |
| 10,737,491 | B2 * | 8/2020 | Odaka | B41J 2/185 |
| 2016/0311221 | A1 | 10/2016 | Menzel et al. | |

FOREIGN PATENT DOCUMENTS

| | | |
|---|---|---|
| JP | 2018-513041 | 5/2018 |

* cited by examiner

*Primary Examiner* — An H Do
(74) *Attorney, Agent, or Firm* — Workman Nydegger

(57) ABSTRACT

A liquid ejecting head includes a substrate where a first nozzle and a second nozzle that eject liquid. The substrate is formed with a plurality of hole portions which communicate with a supply liquid chamber and in each of which a meniscus for absorbing pressure variation of liquid inside the supply liquid chamber is formed. The plurality of hole portions include a first hole portion. A distance between an end portion of a first supply flow path on a side of the supply liquid chamber and the first hole portion is equal to a distance between an end portion of a second supply flow path on a side of the supply liquid chamber and the first hole portion.

20 Claims, 4 Drawing Sheets

LIQUID EJECTING HEAD AND LIQUID EJECTING APPARATUS

The present application is based on, and claims priority from JP Application Serial Number 2019-085194, filed Apr. 26, 2019, the disclosure of which is hereby incorporated by reference herein in its entirety.

BACKGROUND

1. Technical Field

The present disclosure relates to a liquid ejecting head and a liquid ejecting apparatus.

2. Related Art

A liquid ejecting apparatus that ejects liquid such as ink to a medium such as a printing paper has been proposed. For example, JP-T-2018-513041 discloses a liquid discharge apparatus including a plurality of pressure feed chambers filled with liquid supplied from a feeding channel and an actuator that discharges liquid from each pressure feed chamber. On a wall surface of the feeding channel, a dummy nozzle for reducing pressure variation propagating from each pressure feed chamber to the feeding channel is formed.

In a configuration of JP-T-2018-513041, when phases of the pressure variations propagating from each of the plurality of pressure feed chambers are different from each other, a meniscus formed inside the dummy nozzle is disturbed. Therefore, there is a possibility that liquid in the feeding channel leaks from the dummy nozzle.

SUMMARY

According to an aspect of the present disclosure, a liquid ejecting head includes a substrate where a first nozzle and a second nozzle that eject liquid are formed, a first pressure chamber communicating with the first nozzle, a second pressure chamber communicating with the second nozzle, a supply liquid chamber where the substrate constitutes a part of a wall surface, a first supply flow path that makes the supply liquid chamber and the first pressure chamber communicate with each other, and a second supply flow path that makes the supply liquid chamber and the second pressure chamber communicate with each other. The substrate is formed with a plurality of hole portions which communicate with the supply liquid chamber and in each of which a meniscus for absorbing pressure variation of liquid inside the supply liquid chamber is formed. The plurality of hole portions include a first hole portion. A distance between an end portion of the first supply flow path on a side of the supply liquid chamber and the first hole portion is equal to a distance between an end portion of the second supply flow path on a side of the supply liquid chamber and the first hole portion.

According to another aspect of the present disclosure, a liquid ejecting apparatus includes the liquid ejecting head according to a suitable aspect of the present disclosure and a control unit that controls the liquid ejecting head.

DESCRIPTION OF EXEMPLARY EMBODIMENTS

A: First Embodiment

Figure 1:
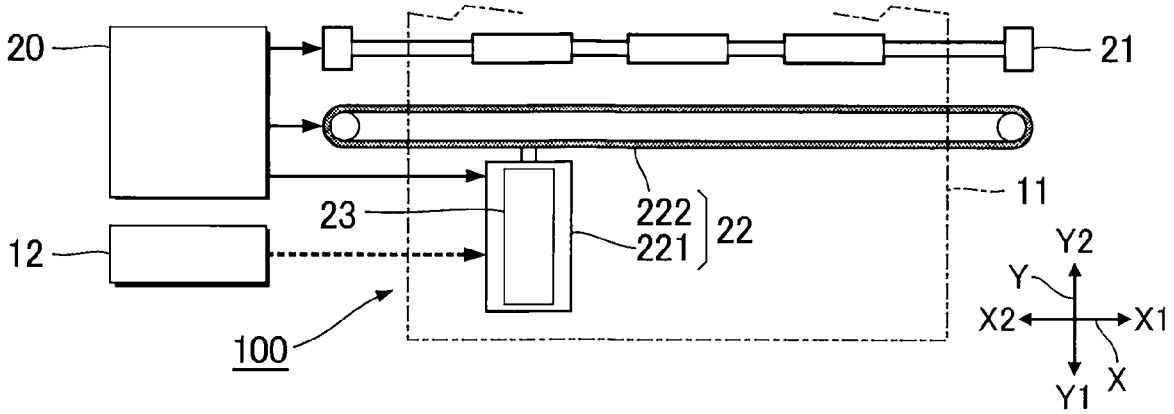
FIG. 1 is a block diagram illustrating a configuration of a liquid ejecting apparatus according to a first embodiment.
Figure 4:
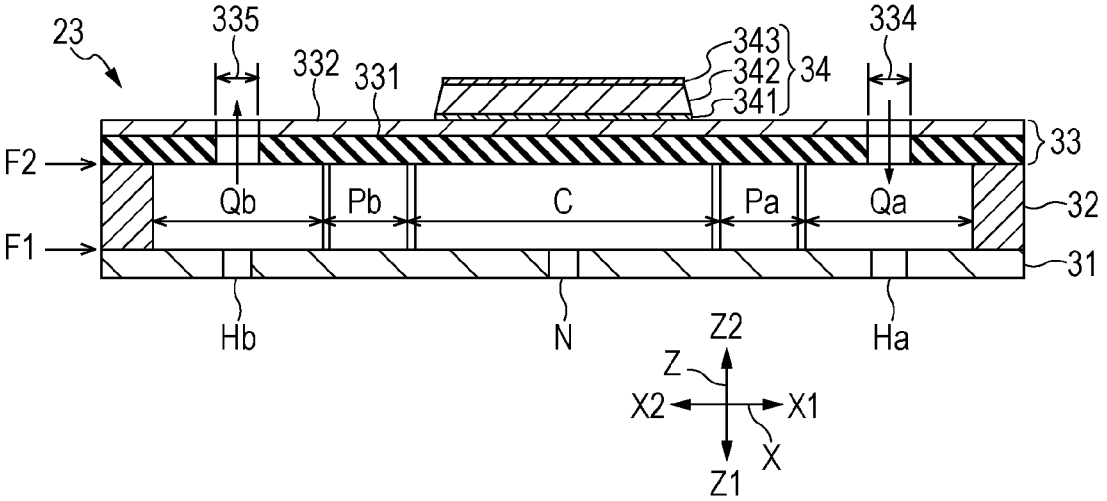
FIG. 4 is a cross-sectional view taken along line IV-IV in FIG. 3.

In the description below, as illustrated in FIGS. 1 and 4, an X axis, a Y axis, and a Z axis perpendicular to each other are assumed. One direction along the X direction as seen from an arbitrary point is written as an X1 direction, and a direction opposite to the X1 direction is written as an X2 direction. Similarly, directions opposite to each other along the Y axis from an arbitrary point are written as a Y1 direction and a Y2 direction, and directions opposite to each other along the Z axis from an arbitrary point are written as a Z1 direction and a Z2 direction. An X-Y plane including the X axis and the Y axis corresponds to, for example, a horizontal plane. The Z axis is an axis line along a vertical direction, and the Z1 direction corresponds to downward in the vertical direction.

FIG. 1 is a configuration diagram illustrating a liquid ejecting apparatus 100 according to a first embodiment. The liquid ejecting apparatus 100 of the first embodiment is an ink jet type printing apparatus that ejects ink droplets, which are an example of liquid, to a medium 11. The medium 11 is typically a printing paper. However, an object to be printed of an arbitrary material such as a resin film or a cloth is used as the medium 11. As illustrated in FIG. 1, the liquid ejecting apparatus 100 is installed with a liquid container 12 that stores ink. For example, a cartridge attachable to and detachable from the liquid ejecting apparatus 100, a bag-like ink pack formed by a flexible film, or an ink tank which can be replenished with ink is used as the liquid container 12.

As illustrated in FIG. 1, the liquid ejecting apparatus 100 includes a control unit 20, a transport mechanism 21, a movement mechanism 22, and a liquid ejecting head 23. The control unit 20 includes, for example, a processing circuit such as a CPU (Central Processing Unit) or an FPGA (Field Programmable Gate Array) and a memory circuit such as a semiconductor memory and controls each element in the liquid ejecting apparatus 100. The control unit 20 is an example of a "control unit".

The transport mechanism 21 transports the medium 11 along the Y axis under control of the control unit 20. The movement mechanism 22 reciprocates the liquid ejecting head 23 along the X axis under control of the control unit 20. The movement mechanism 22 of the first embodiment includes a substantially box-shaped transport body 221 that stores the liquid ejecting head 23 and an endless transport belt 222 to which the transport body 221 is fixed. It is possible to employ a configuration in which a plurality of liquid ejecting heads 23 are mounted on the transport body 221 or a configuration in which the liquid container 12 is mounted on the transport body 221 along with the liquid ejecting head 23.

The liquid ejecting head 23 ejects ink supplied from the liquid container 12 to the medium 11 from a plurality of nozzles under control of the control unit 20. Each liquid ejecting head 23 ejects ink to the medium 11 in parallel with transport of the medium 11 by the transport mechanism 21 and repetitive reciprocation of the transport body 221, so that an image is formed on a surface of the medium 11.

Figure 2:
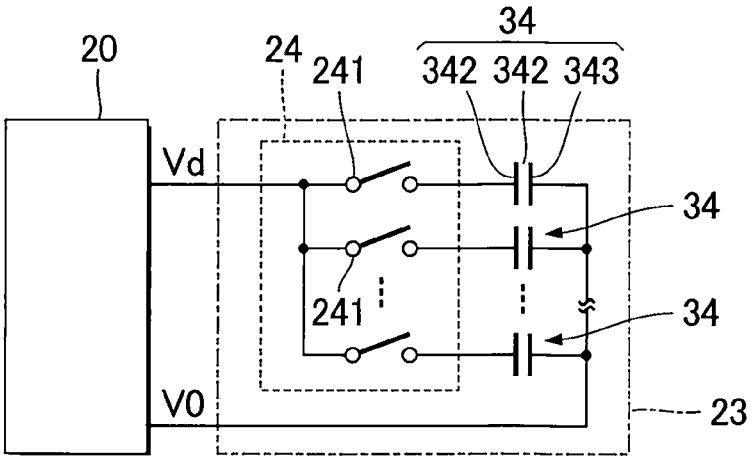
FIG. 2 is a block diagram illustrating a functional configuration of the liquid ejecting apparatus.

FIG. 2 is a block diagram illustrating a functional configuration of the liquid ejecting apparatus 100. The transport mechanism 21 and the movement mechanism 22 are not shown in FIG. 2 for convenience. As illustrated in FIG. 2, the control unit 20 of the first embodiment supplies a plurality of control signals including a drive signal Vd and a predetermined reference voltage V0 to the liquid ejecting head 23. The drive signal Vd is a voltage signal whose voltage varies at a predetermined cycle.

As illustrated in FIG. 2, the liquid ejecting head 23 of the first embodiment includes a plurality of piezoelectric elements 34 respectively corresponding to the plurality of nozzles and a drive circuit 24 that drives each of the plurality of piezoelectric elements 34. The drive circuit 24 includes a plurality of switches 241 respectively corresponding to the plurality of piezoelectric elements 34. Each of the plurality of switches 241 is composed of a transfer gate that switches supply/stop of the drive signal Vd to the piezoelectric element 34 according to various control signals. When the drive signal Vd is supplied to the piezoelectric element 34, the piezoelectric element 34 is deformed. As understood from the above description, the drive signals Vd are supplied in parallel to the plurality of piezoelectric elements 34. That is, the plurality of piezoelectric elements 34 are deformed at the same time.

Figure 3:
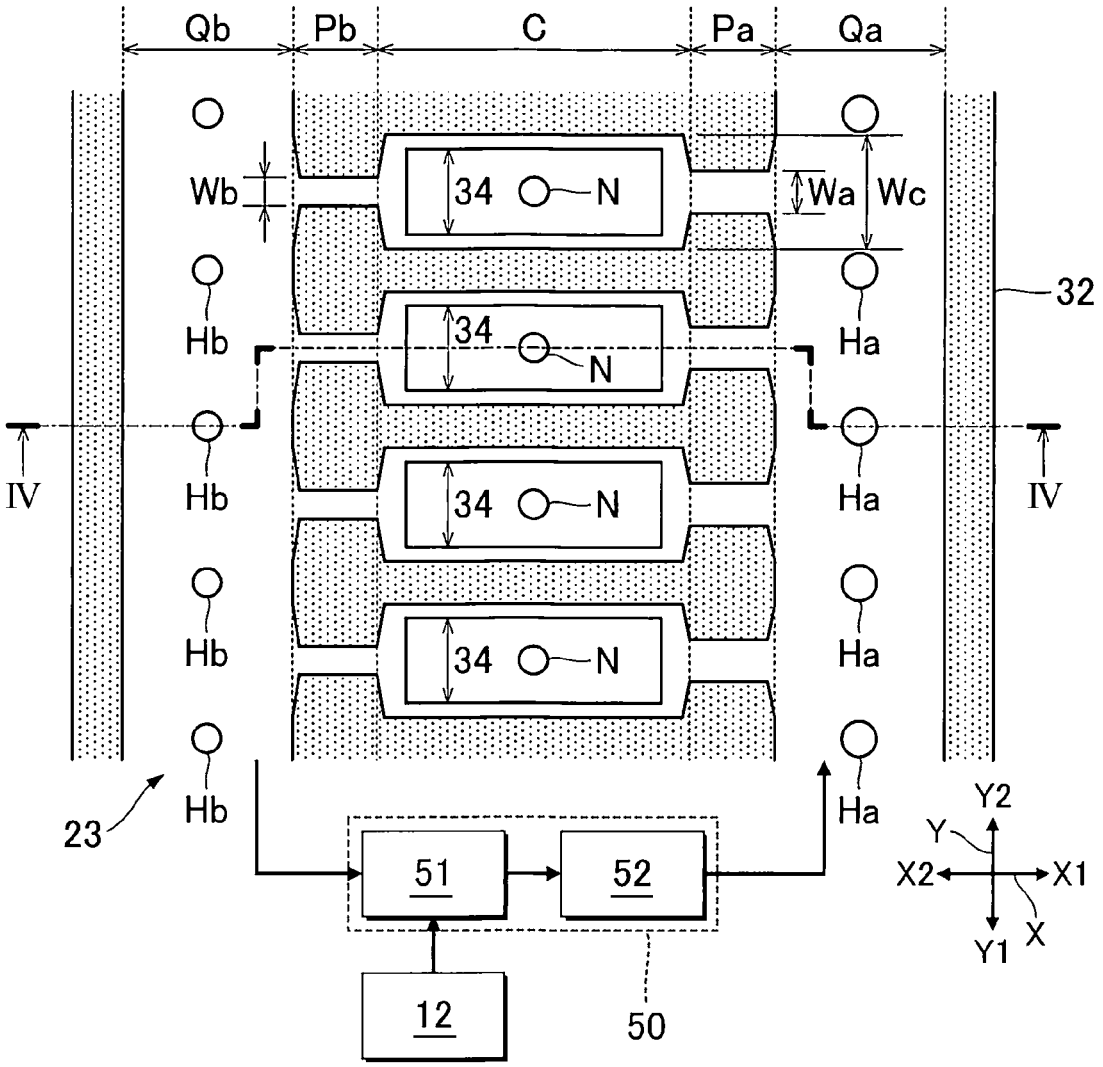
FIG. 3 is a plan view of a liquid ejecting head.

FIG. 3 is a plan view of the liquid ejecting head 23. FIG. 4 is a cross-sectional view taken along line IV-IV in FIG. 3. As illustrated in FIGS. 3 and 4, the liquid ejecting head 23 includes a nozzle substrate 31, a flow path substrate 32, a vibration plate 33, and the plurality of piezoelectric elements 34. The flow path substrate 32 is a plate-like member including a first surface F1 and a second surface F2. The first surface F1 and the second surface F2 are surfaces opposite to each other. The nozzle substrate 31 is joined to the first surface F1 of the flow path substrate 32. The vibration plate 33 is joined to the second surface F2 of the flow path substrate 32. That is, the flow path substrate 32 is interposed between the nozzle substrate 31 and the vibration substrate 33.

The nozzle substrate 31 is a plate-like member where a plurality of nozzles N are formed. Each of the plurality of nozzles N is a through hole from which ink is ejected. As illustrated in FIG. 3, the plurality of nozzles N are arranged at intervals from each other in a direction of Y axis. The nozzle substrate 31 is manufactured by processing a silicon (Si) single crystal substrate by using a semiconductor manufacturing technique such as, for example, photolithography and etching. However, known materials and manufacturing technique can be arbitrary employed to manufacture the nozzle substrate 31. The nozzle substrate 31 of the first embodiment is an example of a "substrate".

The flow path substrate 32 is a plate-like member where flow paths of ink are formed. The flow path formed in the flow path substrate 32 is a space where the nozzle plate 31 forms a bottom surface and the vibration plate 33 forms an upper surface. Specifically, in the flow path substrate 32, a supply liquid chamber Qa, a circulation liquid chamber Qb, a plurality of pressure chambers C, a plurality of supply flow paths Pa, and a plurality of circulation flow paths Pb are formed. The flow path substrate 32 is manufactured by, for example, processing a silicon single crystal substrate by using a semiconductor manufacturing technique in the same manner as the nozzle substrate 31 described above. However, known materials and manufacturing technique can be arbitrary employed to manufacture the flow path substrate 32.

The supply liquid chamber Qa and the circulation liquid chamber Qb are spaces extending along the Y axis. The direction of Y axis is an example of a "first direction". Each of the supply liquid chamber Qa and the circulation liquid chamber Qb is a common liquid chamber continuing over the plurality of nozzles N. The supply liquid chamber Qa and the circulation liquid chamber Qb are juxtaposed at intervals from each other in a direction of X axis. The plurality of pressure chambers C, the plurality of supply flow paths Pa, and the plurality of circulation flow paths Pb are formed between the supply liquid chamber Qa and the circulation liquid chamber Qb in a plan view from a direction of Z axis. The ink to be supplied from the liquid container 12 to the liquid ejecting head 23 is stored in the supply liquid chamber Qa.

The pressure chamber C, the supply flow path Pa, and the circulation flow path Pb are formed for each nozzle N. The plurality of pressure chambers C are arranged at intervals from each other in the direction of Y axis between the supply liquid chamber Qa and the circulation liquid chamber Qb. Each of the plurality of pressure chambers C is a space extending along the X axis. The plurality of pressure chambers C are arranged along the Y axis in an X2 direction with respect to the X2 direction. The X2 direction is an example of a "second direction". As understood from FIGS. 3 and 4, each pressure chamber C communicates with the nozzle N corresponding to the pressure chamber C. A part of the ink filled in the pressure chamber C is ejected from the nozzle N.

Each of the plurality of supply flow paths Pa is a flow path that makes the supply liquid chamber Qa and the pressure chamber C communicate with each other. Specifically, each supply flow path Pa extends along the X axis so as to couple an end portion of the pressure chamber C in the X1 direction with the supply liquid chamber Qa. That is, the plurality of supply flow paths Pa are arranged along the Y axis between an arrangement of the plurality of pressure chambers C and the supply liquid chamber Qa. The ink stored in the supply liquid chamber Qa is supplied to the pressure chambers C through each supply flow path Pa. That is, the ink stored in the supply liquid chamber Qa branches into the plurality of supply flow paths Pa, so that the ink is supplied in parallel to the plurality of pressure chambers C. As understood from the above description, the supply liquid chamber Qa and each supply flow path Pa function as a flow path for supplying ink to each pressure chamber C. A flow path length of the supply flow path Pa is the same as a flow path length of the circulation flow path Pb.

As illustrated in FIG. 3, a flow path width Wa of each supply flow path Pa is smaller than a flow path width Wc of the pressure chamber C. The flow path width Wa is the size of the supply flow path Pa in the direction of Y axis, and the flow path width Wc is the size of the pressure chamber C in the direction of Y axis. As understood from the above description, each supply flow path Pa is a throttle flow path that makes the supply liquid chamber Qa and the pressure chamber C communicate with each other with a predetermined flow path resistance.

Each of the plurality of circulation flow paths Pb is a flow path that makes the circulation liquid chamber Qb and the pressure chamber C communicate with each other. Specifically, each circulation flow path Pb extends along the X axis so as to couple an end portion of the pressure chamber C in the X2 direction with the circulation liquid chamber Qb. Ink that is filled in each pressure chamber C but is not ejected from the nozzle N is supplied to the circulation liquid chamber Qb through the circulation flow path Pb. The inks ejected from the plurality of pressure chambers C respectively to the plurality of circulation flow paths Pb converge in the circulation liquid chamber Qb. As understood from the above description, each circulation flow path Pb and the circulation liquid chamber Qb function as a flow path for ejecting ink from each pressure chamber C.

As illustrated in FIG. 3, the flow path width Wb of each circulation flow path Pb is smaller than the flow path width We of the pressure chamber C. The flow path width Wb is the size of the circulation flow path Pb in the direction of Y axis. As understood from the above description, each circulation flow path Pb is a throttle flow path that makes the pressure chamber C and the circulation liquid chamber Qb communicate with each other with a predetermined flow path resistance. As understood from FIG. 3, the flow path width Wa of the supply flow path Pa exceeds the flow path width Wb of the circulation flow path Pb. That is, in the first embodiment, the flow path resistance of each supply flow path Pa is lower than the flow path resistance of each circulation flow path Pb. Therefore, it is possible to reduce possibility that the ink is excessively discharged from each pressure chamber C to the circulation liquid chamber Qb as compared with a configuration where the flow path resistance of each supply flow path Pa is higher than the flow path resistance of each circulation flow path Pb.

As illustrated in FIG. 3, the liquid ejecting apparatus 100 of the first embodiment includes a circulation mechanism 50. The circulation mechanism 50 is a mechanism that circulates the ink stored in the circulation liquid chamber Qb to the supply liquid chamber Qa. As illustrated in FIG. 3, the circulation mechanism 50 includes a liquid storage chamber 51 and a circulation pump 52. The liquid storage chamber 51 is a container that temporarily stores ink supplied from the liquid container 12 and the circulation liquid chamber Qb. The circulation pump 52 is a pump that transfers ink stored in the liquid storage chamber 51 to the supply liquid chamber Qa.

The vibration plate 33 in FIG. 4 is an elastically deformable plate-like member. The vibration plate 33 of the first embodiment is composed of a laminated layer of a first layer 331 and a second layer 332. The first layer 331 is interposed between the second layer 332 and the flow path substrate 32. The first layer 331 is formed of silicon oxide ($SiO_2$). The second layer 332 is formed of, for example, zirconium oxide ($ZrO_2$: zirconia). The first layer 331 may be integrally formed with the flow path substrate 32. The vibration plate 33 may be formed of a single layer.

As illustrated in FIG. 4, a supply port 334 and a circulation port 335 are formed in the vibration plate 33. The supply port 334 and the circulation port 335 are openings that penetrate the vibration plate 33. The ink supplied from the circulation mechanism 50 passes through the supply port 334 and is stored in the supply liquid chamber Qa. The ink stored in the circulation liquid chamber Qb passes through the circulation port 335 and is supplied to the circulation mechanism 50.

The piezoelectric element 34 is formed on a surface of the vibration plate 33 for each pressure chamber C. Each piezoelectric element 34 is a drive element that ejects ink from the nozzle N by changing pressure of ink in the pressure chamber C. As illustrated in FIG. 4, the piezoelectric element 34 of the first embodiment is a structure body in which a first electrode 341, a piezoelectric body layer 342, and a second electrode 343 are laminated in the Z2 direction. That is, the piezoelectric body layer 342 is interposed between the first electrode 341 and the second electrode 343.

The first electrode 341 is a conductive film formed on a surface of the second layer 332 in the vibration plate 33. A drive signal Vd is supplied to the first electrode 341 from the drive circuit 24. The piezoelectric body layer 342 covers the first electrode 341. The piezoelectric body layer 342 is formed of a known piezoelectric material such as, for example, lead zirconate titanate ($Pb(Zr,Ti)O_3$). The second electrode 343 is a conductive film that covers the piezoelectric body layer 342. The reference voltage V0 is supplied to the second electrode 343. The piezoelectric element 34 is deformed according to a voltage applied between the first electrode 341 and the second electrode 343. When pressure in the pressure chamber C is changed by the deformation of the piezoelectric element 34, the ink in the pressure chamber C is ejected from the nozzle N. The reference voltage V0 may be supplied to the first electrode 341, and the drive signal Vd may be supplied to the second electrode 343. One of the first electrode 341 and the second electrode 343 may be a common electrode continuing over the plurality of piezoelectric elements 34.

As illustrated in FIGS. 3 and 4, in the nozzle substrate 31 of the first embodiment, in addition to the plurality of nozzles N, a plurality of hole portions Ha and a plurality of hole portions Hb are formed. The hole portions Ha and the hole portions Hb are fine holes that penetrate the nozzle substrate 31. In the description below, a configuration in which cross-sectional shapes of the hole portions Ha and the hole portions Hb are circles will be illustrated. However, the hole portions Ha and the hole portions Hb can be formed into arbitrary shapes such as rectangles, polygonal shapes, star shapes, heart shapes, or double-sphere shapes.

The plurality of hole portions Ha are formed inside the supply liquid chamber Qa in plan view, and the plurality of hole portions Hb are formed inside the circulation liquid chamber Qb in plan view. That is, each hole portion Ha communicates with the supply liquid chamber Qa, and each hole portion Hb communicates with the circulation liquid chamber Qb. A meniscus of the ink stored in the supply liquid chamber Qa is formed inside the hole portion Ha. Similarly, a meniscus of the ink stored in the circulation liquid chamber Qb is formed inside the hole portion Hb.

A pressure variation generated in the pressure chamber C by the deformation of the piezoelectric element 34 propagates to the inside of the supply liquid chamber Qa through the supply flow path Pa. When the meniscus in each hole portion Ha vibrates due to the pressure variation that arrives at the supply liquid chamber Qa from the pressure chambers C, a pressure variation of the ink in the supply liquid chamber Qa is reduced. As understood from the above description, the meniscus in each hole portion Ha functions as a vibration absorbing mechanism that absorbs the pressure variation of the ink in the supply liquid chamber Qa. The pressure variation in the pressure chamber C also propagates to the inside of the circulation liquid chamber Qb through the circulation flow path Pb. When the meniscus in each hole portion Hb vibrates due to the pressure variation that arrives at the circulation liquid chamber Qb from the pressure chambers C, a pressure variation of the ink in the circulation liquid chamber Qb is reduced. As understood from the above description, the meniscus in each hole portion Hb functions as a vibration absorbing mechanism that absorbs the pressure variation of the ink in the circulation liquid chamber Qb. No ink is ejected from the hole portions Ha and the hole portions Hb, so that the hole portions Ha and the hole portions Hb are also referred to as dummy nozzles.

In a configuration in which a cross-section area of an outer end portion (hereinafter referred to as an external end portion) of the hole portion H(Ha, Hb) is large, the ink may leak from each hole portion H. Therefore, a configuration in which the cross-section area of the external end portion of each hole portion H is smaller than a cross-section area of an external end portion of each nozzle N is suitable. According to the above configuration, a possibility that the ink leaks from each hole portion H is reduced. Therefore, it is possible to reduce a possibility that the medium 11 is damaged by adhesion of ink leaked from each hole portion H. The external end portion of the hole portion H is one end opposite to the flow path substrate 32 in the hole portion H (that is, an end portion in the Z1 direction). That is, the cross-section area of the external end portion of the hole portion H is a cross-section area of the hole portion H on the surface of the nozzle substrate 31 opposite to the flow path substrate 32. Similarly, the external end portion of the nozzle N means one end of the nozzle N opposite to the flow path substrate 32 (that is, an end portion in the Z1 direction). That is, the cross-section area of the external end portion of the nozzle N is a cross-section area of the nozzle N on the surface of the nozzle substrate 31 opposite to the flow path substrate 32.

As described above, in the first embodiment, the flow path resistance of each supply flow path Pa is lower than the flow path resistance of each circulation flow path Pb. Therefore, there is a tendency that the pressure variation in the pressure chamber C propagates to supply liquid chamber Qa more easily than to the circulation liquid chamber Qb. Considering the above situation, in the first embodiment, a condition of forming the hole portions Ha and the hole portions Hb is selected so that vibration absorbing performance by the plurality of hole portions Ha exceeds vibration absorbing performance by the plurality of hole portions Hb.

The larger the cross-section area of the external end portion of the hole portion H(Ha, Hb), the more the vibration absorbing performance that reduces the pressure variation is improved. Considering the above situation, in the first embodiment, the cross-section area of the external end portion of each hole portion Ha is larger than the cross-section area of the external end portion of each hole portion Hb. Specifically, the inside diameter of the hole portion Ha exceeds the inside diameter of the hole portion Hb. Therefore, in the first embodiment, the vibration absorbing performance by the plurality of hole portions Ha exceeds the vibration absorbing performance by the plurality of hole portions Hb. According to the above configuration, regardless of a configuration in which the pressure variation propagates to the supply liquid chamber Qa more easily than to the circulation liquid chamber Qb, there is an advantage that the pressure variation in the supply liquid chamber Qa can be effectively reduced.

The greater the number of the hole portions H, the more the vibration absorbing performance that reduces the pressure variation is improved. Considering the above situation, in the first embodiment, the number of the plurality of hole portions Ha exceeds the number of the plurality of hole portions Hb. Therefore, in the first embodiment, the vibration absorbing performance by the plurality of hole portions Ha exceeds the vibration absorbing performance by the plurality of hole portions Hb. According to the above configuration, regardless of a configuration in which the pressure variation propagates to the supply liquid chamber Qa more easily than to the circulation liquid chamber Qb, there is an advantage that the pressure variation in the supply liquid chamber Qa can be effectively reduced.

The greater the total sum of the cross-section areas (hereinafter referred to as "total area") of the external end portions of the hole portions H, the more the vibration absorbing performance that reduces the pressure variation is improved. Considering the above situation, in the first embodiment, the total area of the external end portions of the plurality of hole portions Ha exceeds the total area of the external end portions of the plurality of hole portions Hb. Therefore, in the first embodiment, the vibration absorbing performance by the plurality of hole portions Ha exceeds the vibration absorbing performance by the plurality of hole portions Hb. According to the above configuration, regardless of a configuration in which the pressure variation propagates to the supply liquid chamber Qa more easily than to the circulation liquid chamber Qb, there is an advantage that the pressure variation in the supply liquid chamber Qa can be effectively reduced.

Figure 5:
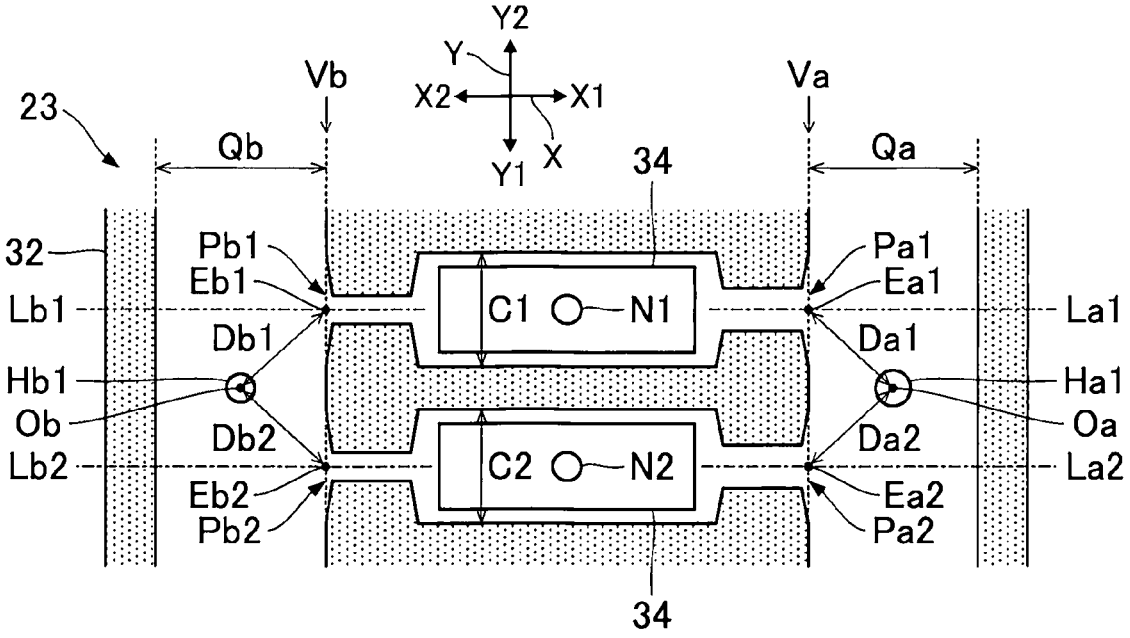
FIG. 5 is an explanatory diagram related to positions of hole portions.

FIG. 5 is an explanatory diagram related to positions of the hole portions Ha and the hole portions Hb. In the description below, two arbitrary nozzles N(N1 and N2) adjacent to each other along the Y axis are paid attention. The nozzle N1 is an example of a "first nozzle", and the nozzle N2 is an example of a "second nozzle". In the description below, a code of an element corresponding to the nozzle N1 is added with a subscript "1", and a code of an element corresponding to the nozzle N2 is added with a subscript "2". For example, FIG. 5 shows a pressure chamber C1 communicating with the nozzle N1 and a pressure chamber C2 communicating with the nozzle N2. The pressure chamber C1 is an example of a "first pressure chamber" and the pressure chamber C2 is an example of a "second pressure chamber".

The pressure chamber C1 communicates with the supply liquid chamber Qa through a supply flow path Pa1, and the pressure chamber C2 communicates with the supply liquid chamber Qa through a supply flow path Pa2. The supply flow path Pa1 is an example of a "first supply flow path", and the supply flow path Pa2 is an example of a "second supply flow path". The pressure chamber C1 communicates with the circulation liquid chamber Qb through a circulation flow path Pb1, and the pressure chamber C2 communicates with the circulation liquid chamber Qb through a circulation flow path Pb2. The circulation flow path Pb1 is an example of a "first circulation flow path", and the circulation flow path Pb2 is an example of a "second circulation flow path".

As illustrated in FIG. 5, the plurality of hole portions Ha corresponding to the supply liquid chamber Qa include one hole portion Ha1. The hole portion Ha1 is an example of a "first hole portion". A position of the hole portion Ha1 on the Y axis is located between the supply flow path Pa1 and the supply flow path Pa2.

A distance Da1 shown in FIG. 5 is a distance between an end portion Ea1 of the supply flow path Pa1 on the side of the supply liquid chamber Qa and the hole portion Ha1. The end portion Ea1 of the supply flow path Pa1 is an intersection point between a virtual plane Va including a side wall surface located in the X2 direction in the supply liquid chamber Qa and a central axis La1 of the supply flow path Pa1. The distance Da1 is defined as a distance between the end portion Ea1 of the supply flow path Pa1 and a center Oa of the hole portion Ha1. A distance Da2 shown in FIG. 5 is a distance between an end portion Ea2 of the supply flow path Pa2 on the side of the supply liquid chamber Qa and the hole portion Ha1. The end portion Ea2 of the supply flow path Pa2 is an intersection point between the virtual plane Va described above and a central axis La2 of the supply flow path Pa2. The distance Da2 is defined as a distance between the end portion Ea2 of the supply flow path Pa2 and the center Oa of the hole portion Ha1.

As illustrated in FIG. 5, the distance Da1 and the distance Da2 are equal. The fact that the distance Da1 and the distance Da2 are "equal" includes a case in which the distance Da1 and the distance Da2 substantially match with each other in addition to a case in which the distance Da1 and the distance Da2 completely match with each other. The fact that the distance Da1 and the distance Da2 "substantially match with each other" means, for example, a case in which a difference between the distance Da1 and the distance Da2 is within a range of manufacturing error. For example, when one of the distance Da1 and the distance Da2 is ±10% or less (more suitably ±5% or less) of the other, the distance Da1 and the distance Da2 are interpreted to substantially match with each other.

As described above, in the first embodiment, the distance Da1 between the end portion Eat of the supply flow path Pa1 and the hole portion Ha1 is equal to the distance Da2 between the end portion Ea2 of the supply flow path Pa2 and the hole portion Ha1. According to the above configuration, a phase of the pressure variation propagating from the pressure chamber C1 to the hole portion Ha1 and a phase of the pressure variation propagating from the pressure chamber C2 to the hole portion Ha1 can be close to each other. That is, the possibility that the meniscus in the hole portion Ha1 is disturbed due to a phase difference between the pressure variation propagating from the pressure chamber C1 and the pressure variation propagating from the pressure chamber C2 is reduced. Therefore, there is an advantage that it is possible to reduce the possibility that ink leaks from the hole portion Ha1 due to the disturbance of the meniscus in the hole portion Ha1.

As illustrated in FIG. 5, the plurality of hole portions Hb corresponding to the circulation liquid chamber Qb includes one hole portion Hb1. The hole portion Hb1 is an example of a "second hole portion". A position of the hole portion Hb1 on the Y axis is located between the circulation flow path Pb1 and the circulation flow path Pb2.

A distance Db1 shown in FIG. 5 is a distance between an end portion Eb1 of the circulation flow path Pb1 on the side of the circulation liquid chamber Qb and the hole portion Hb1. The end portion Eb1 of the circulation flow path Pb1 is an intersection point between a virtual plane Vb including a side wall surface located in the X1 direction in the circulation liquid chamber Qb and a central axis Lb1 of the circulation flow path Pb1. The distance Db1 is defined as a distance between the end portion Eb1 of the circulation flow path Pb1 and a center Ob of the hole portion Hb1. A distance Db2 shown in FIG. 5 is a distance between an end portion Eb2 of the circulation flow path Pb2 on the side of the circulation liquid chamber Qb and the hole portion Hb1. The end portion Eb2 of the circulation flow path Pb2 is an intersection point between the virtual plane Vb described above and a central axis Lb2 of the circulation flow path Pb2. The distance Db2 is defined as a distance between the end portion Eb2 of the circulation flow path Pb2 and the center Ob of the hole portion Hb1.

As illustrated in FIG. 5, the distance Db1 and the distance Db2 are equal. The fact that the distance Db1 and the distance Db2 are "equal" includes a case in which the distance Db1 and the distance Db2 substantially match with each other in addition to a case in which the distance Db1 and the distance Db2 completely match with each other. The fact that the distance Db1 and the distance Db2 "substantially match with each other" means, for example, a case in which a difference between the distance Db1 and the distance Db2 is within a range of manufacturing error. For example, when one of the distance Db1 and the distance Db2 is ±10% or less (more suitably ±5% or less) of the other, the distance Db1 and the distance Db2 are interpreted to substantially match with each other.

As described above, in the first embodiment, the distance Db1 between the end portion Eb1 of the circulation flow path Pb1 and the hole portion Hb1 is equal to the distance Db2 between the end portion Eb2 of the circulation flow path Pb2 and the hole portion Hb1. According to the above configuration, a phase of the pressure variation propagating from the pressure chamber C1 to the hole portion Hb1 and a phase of the pressure variation propagating from the pressure chamber C2 to the hole portion Hb1 can be close to each other. That is, the possibility that the meniscus in the hole portion Hb1 is disturbed due to a phase difference between the pressure variation propagating from the pressure chamber C1 and the pressure variation propagating from the pressure chamber C2 is reduced. Therefore, there is an advantage that it is possible to reduce the possibility that ink leaks from the hole portion Hb1 due to the disturbance of the meniscus in the hole portion Hb1.

B: Second Embodiment

The second embodiment will be described. In each form illustrated below, for elements whose function is the same as those of the first embodiment, signs used in the description of the first embodiment are used as is and detailed description of each element will be appropriately omitted.

Figure 6:
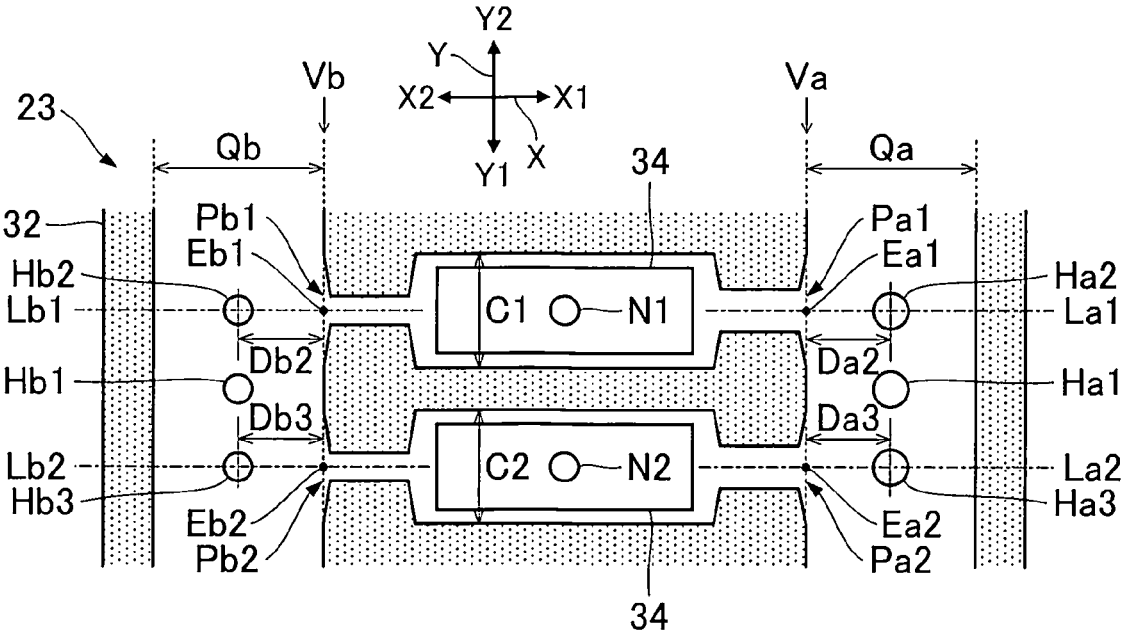
FIG. 6 is a plan view of a liquid ejecting head in a second embodiment.

FIG. 6 is a plan view of the liquid ejecting head 23 in the second embodiment. As illustrated in FIG. 6, the plurality of hole portions Ha in the second embodiment include a hole portion Ha2 and a hole portion Ha3 in addition to the hole portion Ha1 which is the same as that in the first embodiment. The hole portion Ha2 is an example of a "third hole portion" and the hole portion Ha3 is an example of a "fourth hole portion". The hole portion Ha2 corresponds to the nozzle N1 and the hole portion Ha3 corresponds to the nozzle N2. Specifically, the hole portion Ha2 is located on the central axis La1 of the supply flow path Pa1 and the hole portion Ha3 is located on the central axis La2 of the supply flow path Pa2.

The distance Da2 in FIG. 6 is a distance between the end portion Eat of the supply flow path Pa1 and the center of the hole portion Ha2. The distance Da3 is a distance between the end portion Ea2 of the supply flow path Pa2 and the center of the hole portion Ha3. As understood from FIG. 6, the distance Da2 and the distance Da3 are equal. The fact that the distance Da2 and the distance Da3 are "equal" includes a case in which the distance Da2 and the distance Da3 substantially match with each other in addition to a case in which the distance Da2 and the distance Da3 completely match with each other.

As described above, in the second embodiment, the hole portion Ha2 corresponding to the supply flow path Pa1 and the hole portion Ha3 corresponding to the supply flow path Pa2 are formed. The hole portion Ha2 is closer to the supply flow path Pa1 than the hole portion Ha1, and the hole portion Ha3 is closer to the supply flow path Pa2 than the hole portion Ha1.

The closer the hole portion Ha is to the supply flow path Pa, the more the vibration absorbing performance that reduces the pressure variation propagating to the supply liquid chamber Qa through the supply flow path Pa by the meniscus in the hole portion Ha is improved. According to the second embodiment, the hole portion Ha2 is formed close to the supply flow path Pa1 and the hole portion Ha3 is formed close to the supply flow path Pa2, so that there is an advantage to be able to effectively reduce the pressure variation propagating from the supply flow path Pa1 or the supply flow path Pa2 to the supply liquid chamber Qa.

As illustrated in FIG. 6, the plurality of hole portions Hb in the second embodiment include a hole portion Hb2 and a hole portion Hb3 in addition to the hole portion Hb1 which is the same as that in the first embodiment. The hole portion Hb2 corresponds to the nozzle N1 and the hole portion Hb3 corresponds to the nozzle N2. Specifically, the hole portion Hb2 is located on the central axis Lb1 of the circulation flow path Pb1 and the hole portion Hb3 is located on the central axis Lb2 of the circulation flow path Pb2.

The distance Db2 in FIG. 6 is a distance between the end portion Eb1 of the circulation flow path Pb1 and the center of the hole portion Hb2. The distance Db3 is a distance between the end portion Eb2 of the circulation flow path Pb2 and the center of the hole portion Hb3. As understood from FIG. 6, the distance Db2 and the distance Db3 are equal. The fact that the distance Db2 and the distance Db3 are "equal" includes a case in which the distance Db2 and the distance Db3 substantially match with each other in addition to a case in which the distance Db2 and the distance Db3 completely match with each other.

As described above, in the second embodiment, the hole portion Hb2 corresponding to the circulation flow path Pb1 and the hole portion Hb3 corresponding to the circulation flow path Pb2 are formed. The hole portion Hb2 is closer to the circulation flow path Pb1 than the hole portion Hb1, and the hole portion Hb3 is closer to the circulation flow path Pb2 than the hole portion Hb1.

The closer the hole portion Hb is to the circulation flow path Pb, the more the vibration absorbing performance that reduces the pressure variation propagating to the circulation liquid chamber Qb through the circulation flow path Pb by the meniscus in the hole portion Hb is improved. According to the second embodiment, the hole portion Hb2 is formed close to the circulation flow path Pb1 and the hole portion Hb3 is formed close to the circulation flow path Pb2, so that there is an advantage to be able to effectively reduce the pressure variation propagating from the circulation flow path Pb1 or the circulation flow path Pb2 to the supply liquid chamber Qa.

C: Third Embodiment

Figure 7:
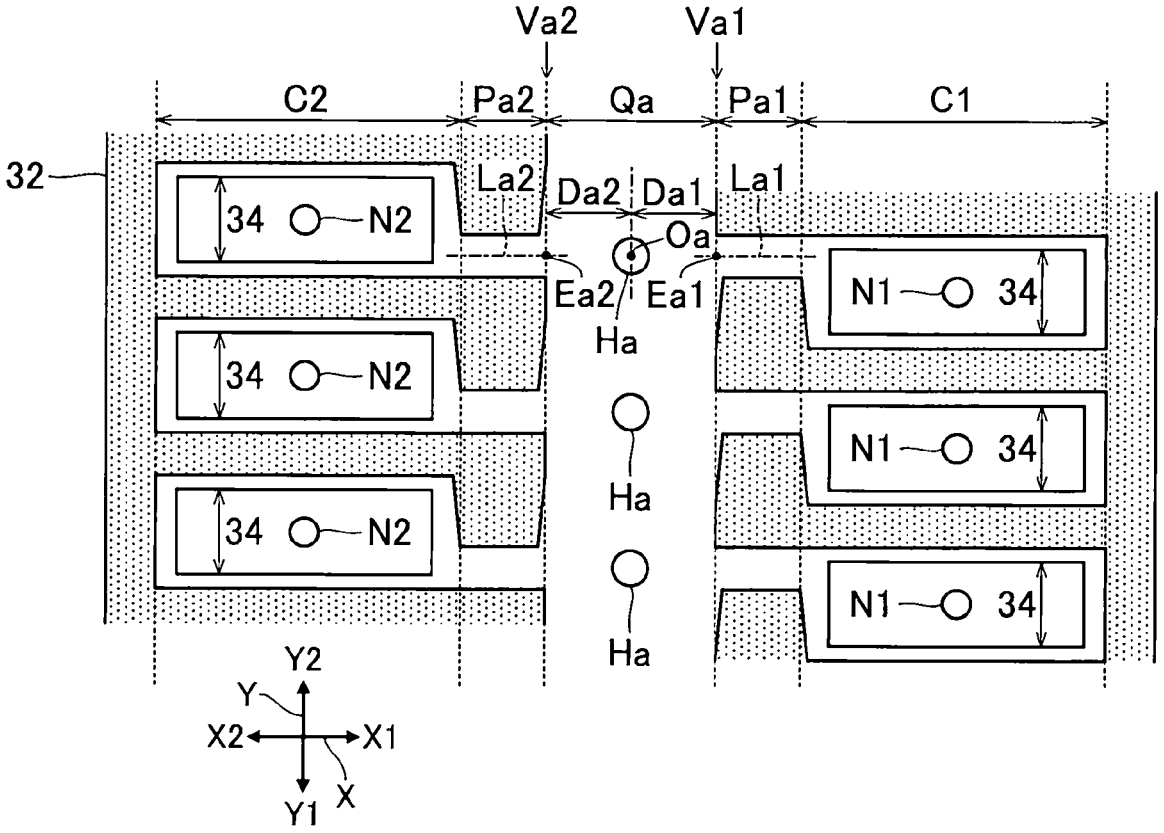
FIG. 7 is a plan view of a liquid ejecting head in a third embodiment.

FIG. 7 is a plan view of the liquid ejecting head 23 in the third embodiment. As illustrated in FIG. 7, a plurality of nozzles N1 and a plurality of nozzles N2 are formed in the nozzle substrate 31 of the third embodiment. The plurality of nozzles N1 are arranged at intervals from each other in the direction of Y axis, and the plurality of nozzles N2 are arranged at intervals from each other in the direction of Y axis. The arrangement of the plurality of nozzles N1 and the arrangement of the plurality of nozzles N2 are juxtaposed at intervals from each other in the direction of X axis. In the direction of Y axis, the positions of the nozzles N1 are different from the positions of the nozzles N2.

As illustrated in FIG. 7, the supply liquid chamber Qa, a plurality of pressure chambers C1, a plurality of pressure chambers C2, a plurality of supply flow paths Pa1, and a plurality of supply flow paths Pa2 are formed in the flow path substrate 32 of the third embodiment. The plurality of circulation flow paths Pb and the circulation liquid chamber Qb are not formed in the flow path substrate 32 of the third embodiment. That is, the liquid ejecting apparatus 100 of the third embodiment does not include a mechanism that circulates ink. The pressure chamber C1 is an example of a "first pressure chamber" and the pressure chamber C2 is an example of a "second pressure chamber". The supply flow path Pa1 is an example of a "first supply flow path", and the supply flow path Pa2 is an example of a "second supply flow path".

As illustrated in FIG. 7, the pressure chamber C1 and the supply flow path Pa1 are formed for each nozzle N1 and the pressure chamber C2 and the supply flow path Pa2 are formed for each nozzle N2. The plurality of pressure chambers C1 are arranged at intervals from each other in the direction of Y axis, and the plurality of pressure chambers C2 are arranged at intervals from each other in the direction of Y axis. The supply liquid chamber Qa is a space extending in the direction of Y axis between the arrangement of the plurality of pressure chambers C1 and the arrangement of the plurality of pressure chambers C2. That is, the plurality of pressure chambers C1 are located in the X1 direction with respect to the supply liquid chamber Qa, and the plurality of pressure chambers C2 are located in the X2 direction with respect to the supply liquid chamber Qa. As understood from the above description, the supply liquid chamber Qa of the third embodiment is located between the pressure chambers C1 and the pressure chambers C2.

The supply flow path Pa1 corresponding to each pressure chamber C1 makes the pressure chamber C1 and the supply liquid chamber Qa communicate with each other. Similarly, the supply flow path Pa2 corresponding to each pressure chamber C2 makes the pressure chamber C2 and the supply liquid chamber Qa communicate with each other. The ink stored in the supply liquid chamber Qa is supplied to the pressure chamber C1 through each supply flow path Pa1 and supplied to the pressure chamber C2 through each supply flow path Pa2. The pressure variation generated in the pressure chamber C1 by the deformation of the piezoelectric element 34 propagates to the supply liquid chamber Qa through the supply flow path Pa1. Similarly, the pressure variation generated in the pressure chamber C2 by the deformation of the piezoelectric element 34 propagates to the supply liquid chamber Qa through the supply flow path Pa2.

In addition to the plurality of nozzles N1 and the plurality of nozzles N2, a plurality of hole portions Ha are formed in the nozzle substrate 31 of the third embodiment. In the same manner as in the first embodiment, the plurality of hole portions Ha are formed inside the supply liquid chamber Qa in plan view. FIG. 7 shows the distance Da1 and the distance Da2 for one hole portion Ha (an example of a first hole portion). The distance Da1 is a distance between the end portion Ea1 of the supply flow path Pa1 and the hole portion Ha. The end portion Ea1 is an intersection point between a virtual plane Va1 including a side wall surface located in the X1 direction in the supply liquid chamber Qa and the central axis La1 of the supply flow path Pa1. The distance Da2 is a distance between the end portion Ea2 of the supply flow path Pa2 and the hole portion Ha. The end portion Ea2 is an intersection point between a virtual plane Va2 including a side wall surface located in the X2 direction in the supply liquid chamber Qa and the central axis La2 of the supply flow path Pa2.

As illustrated in FIG. 7, the distance Da1 and the distance Da2 are equal. In the same manner as in the first embodiment, the fact that the distance Da1 and the distance Da2 are "equal" includes a case in which the distance Da1 and the distance Da2 substantially match with each other in addition to a case in which the distance Da1 and the distance Da2 completely match with each other.

As described above, in the third embodiment, the distance Da1 between the end portion Ea1 of the supply flow path Pa1 and the hole portion Ha is equal to the distance Da2 between the end portion Ea2 of the supply flow path Pa2 and the hole portion Ha. According to the above configuration, a phase of the pressure variation propagating from the pressure chamber C1 to the hole portion Ha and a phase of the pressure variation propagating from the pressure chamber C2 to the hole portion Ha can be close to each other. That is, in the same manner as in the first embodiment, the possibility that the meniscus in the hole portion Ha is disturbed due to a phase difference between the pressure variation propagating from the pressure chamber C1 and the pressure variation propagating from the pressure chamber C2 is reduced. Therefore, there is an advantage that it is possible to reduce the possibility that ink leaks from the hole portion Ha due to the disturbance of the meniscus in the hole portion Ha.

Further, in the third embodiment, the supply liquid chamber Qa is supplied for the plurality of nozzles N1 and the plurality of nozzles N2, so that there is an advantage that the configuration of the liquid ejecting head 23 is simplified as compared with a configuration in which the supply liquid chamber Qa is formed separately for each of the arrangement of the plurality of nozzles N1 and the arrangement of the plurality of nozzles N2.

D: Modified Example

Each embodiment illustrated above can be variously modified. Specific modification aspects that can be applied to each embodiment described above will be illustrated below. Two or more aspects selected from illustrative examples described below can be appropriately combined to the extent that they do not contradict each other.

Figure 8:
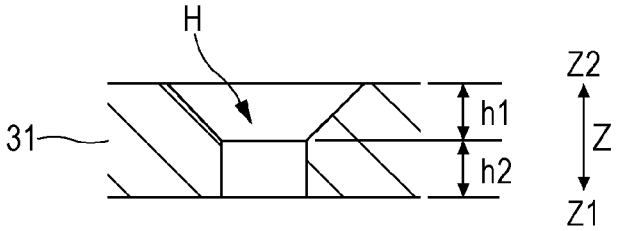
FIG. 8 is a cross-sectional view of hole portions in a modified example.

(1) Although straight-pipe shaped hole portions H(Ha, Hb) are illustrated in each embodiment described above, the shape of the hole portion H is not limited to illustrative examples described above. For example, the hole portion H having a shape including an inclined surface inclining with respect to the surface of the nozzle substrate 31 may be formed. For example, the hole portion H illustrated in FIG. 8 is sectioned into a first section h1 and a second section h2 along the Z axis. The first section h1 is located in the Z2 direction with respect to the second section h2. That is, the first section h1 is located between the second section h2 and the flow path substrate 32. The nozzle N may be formed into the same shape as that of the hole portion H in FIG. 8.

The first section h1 is a portion configured with a truncated cone-shaped inclined surface whose inside diameter increases as the distance to the flow path substrate 32 decreases. On the other hand, the second section h2 is a straight-pipe shaped portion whose inside diameter is constant over the entire section along the Z axis. According to the above configuration, the surface area of the meniscus is secured by enlargement of the diameter of the first section h1, so that it is possible to improve the vibration absorbing performance as compared with a configuration in which the hole portion H is formed by only the straight-pipe shaped second section h2. On the other hand, an appropriate flow path resistance is secured by the second section h2 whose diameter is smaller than that of the first section h1, so that it is possible to effectively suppress leakage of ink from the hole portion H as compared with a configuration in which the hole portion H is formed by only the truncated cone-shaped first section h1. It is also possible to employ a configuration in which the hole portion H is formed by only a straight-pipe shaped portion or a configuration in which the hole portion H is formed by only a truncated cone-shaped portion. Further, in the hole portion H having a shape whose inside diameter changes according to a position on the Z axis as in the illustrative example in FIG. 8, the meniscus is easily held in the straight-pipe shaped second section h2 by surface tension, so that a possibility that the meniscus moves to the first section h1 is reduced. According to the above configuration, variation of the position of the meniscus in each hole portion H is reduced. Therefore, it is possible to reduce variation of the vibration absorbing performance of the plurality of hole portions H.

(2) The drive element that ejects ink stored in the pressure chamber C from the nozzle N is not limited to the piezoelectric element 34 illustrated in each embodiment described above. For example, a heat generating element that generates air bubbles inside the pressure chamber C by heating and changes pressure may be used as the drive element.

(3) While the serial type liquid ejecting apparatus 100 that reciprocates the transport body 221 mounted with the liquid ejecting head 23 is illustrated in each embodiment described above, the present disclosure can also be applied to a line type liquid ejecting apparatus in which a plurality of nozzles N are distributed over the entire width of the medium 11.

(4) The liquid ejecting apparatus 100 illustrated in each embodiment described above can be employed in various devices such as a facsimile apparatus and a copy machine in addition to a device dedicated for printing. The application of the liquid ejecting apparatus of the present disclosure is not limited to printing. For example, the liquid ejecting apparatus that ejects a solution of a color material is used as a manufacturing apparatus that forms a color filter of a display apparatus such as a liquid crystal display panel. Further, the liquid ejecting apparatus that ejects a solution of a conductive material is used as a manufacturing apparatus that forms wiring and electrodes of a wiring substrate. Further, the liquid ejecting apparatus that ejects a solution of an organic substance related to a living body is used as, for example, a manufacturing apparatus that manufactures biochips.

What is claimed is:

1. A liquid ejecting head comprising:

a substrate where a first nozzle and a second nozzle that eject liquid are formed;

a first pressure chamber communicating with the first nozzle;

a second pressure chamber communicating with the second nozzle;

a supply liquid chamber where the substrate constitutes a part of a wall surface;

a first supply flow path that makes the supply liquid chamber and the first pressure chamber communicate with each other; and a second supply flow path that makes the supply liquid chamber and the second pressure chamber communicate with each other, wherein the substrate is formed with a plurality of hole portions which communicate with the supply liquid chamber and in each of which a meniscus for absorbing pressure variation of liquid inside the supply liquid chamber is formed, the plurality of hole portions include a first hole portion, and a distance between an end portion of the first supply flow path on a side of the supply liquid chamber and the first hole portion is equal to a distance between an end portion of the second supply flow path on a side of the supply liquid chamber and the first hole portion.

2. The liquid ejecting head according to claim 1, further comprising:

a circulation liquid chamber where the substrate constitutes a part of a wall surface and which circulates liquid to the supply liquid chamber;

a first circulation flow path that makes the circulation liquid chamber and the first pressure chamber communicate with each other; and a second circulation flow path that makes the circulation liquid chamber and the second pressure chamber communicate with each other, wherein the substrate is formed with a plurality of hole portions which communicate with the circulation liquid chamber and in each of which a meniscus for absorbing pressure variation of liquid inside the circulation liquid chamber is formed, the plurality of hole portions which communicate with the circulation liquid chamber include a second hole portion, and a distance between an end portion of the first circulation flow path on a side of the circulation liquid chamber and the second hole portion is equal to a distance between an end portion of the second circulation flow path on a side of the circulation liquid chamber and the second hole portion.

3. The liquid ejecting head according to claim 2, wherein cross-section areas of external end portions of the first nozzle and the second nozzle are larger than cross-section areas of external end portions of the first hole portion and the second hole portion.

4. A liquid ejecting apparatus comprising:

the liquid ejecting head according to claim 3; and a control unit that controls the liquid ejecting head.

5. The liquid ejecting head according to claim 2, wherein a flow path resistance of each of the first supply flow path and the second supply flow path is lower than a flow path resistance of each of the first circulation flow path and the second circulation flow path.

6. The liquid ejecting head according to claim 5, wherein a cross-section area of an external end portion of the first hole portion exceeds a cross-section area of an external end portion of the second hole portion.

7. A liquid ejecting apparatus comprising:

the liquid ejecting head according to claim 6; and a control unit that controls the liquid ejecting head.

8. A liquid ejecting apparatus comprising:

the liquid ejecting head according to claim 5; and a control unit that controls the liquid ejecting head.

9. The liquid ejecting head according to claim 2, wherein the number of hole portions communicating with the supply liquid chamber exceeds the number of hole portions communicating with the circulation liquid chamber.

10. A liquid ejecting apparatus comprising:

the liquid ejecting head according to claim 9; and a control unit that controls the liquid ejecting head.

11. The liquid ejecting head according to claim 2, wherein a total sum of cross-section areas of external end portions of the plurality of hole portions communicating with the supply liquid chamber exceeds a total sum of cross-section areas of external end portions of the plurality of hole portions communicating with the circulation liquid chamber.

12. A liquid ejecting apparatus comprising:

the liquid ejecting head according to claim 11; and a control unit that controls the liquid ejecting head.

13. A liquid ejecting apparatus comprising:

the liquid ejecting head according to claim 2; and a control unit that controls the liquid ejecting head.

14. The liquid ejecting head according to claim 1, wherein the supply liquid chamber extends in a first direction, and the first pressure chamber and the second pressure chamber are arranged in the first direction.

15. The liquid ejecting head according to claim 14, wherein the plurality of hole portions include a third hole portion and a fourth hole portion, and a distance between the end portion of the first supply flow path on the side of the supply liquid chamber and the third hole portion is equal to a distance between the end portion of the second supply flow path on the side of the supply liquid chamber and the fourth hole portion.

16. A liquid ejecting apparatus comprising:

the liquid ejecting head according to claim 15; and a control unit that controls the liquid ejecting head.

17. A liquid ejecting apparatus comprising:

the liquid ejecting head according to claim 14; and a control unit that controls the liquid ejecting head.

18. The liquid ejecting head according to claim 1, wherein the supply liquid chamber is located between the first pressure chamber and the second pressure chamber.

19. A liquid ejecting apparatus comprising:

the liquid ejecting head according to claim 18; and a control unit that controls the liquid ejecting head.

20. A liquid ejecting apparatus comprising:

the liquid ejecting head according to claim 1; and a control unit that controls the liquid ejecting head.

* * * * *